US009803302B2

(12) United States Patent
Tsai

(10) Patent No.: US 9,803,302 B2
(45) Date of Patent: Oct. 31, 2017

(54) METHOD FOR CONTROLLING SEWING OPERATING OF A SEWING MACHINE

(71) Applicant: Zeng Hsing Industrial Co., Ltd., Taichung (TW)

(72) Inventor: Jung-Nan Tsai, Taichung (TW)

(73) Assignee: Zeng Hsing Industrial Co., Ltd., Taichung (TW)

( * ) Notice: Subject to any disclaimer, the term of this patent is extended or adjusted under 35 U.S.C. 154(b) by 244 days.

(21) Appl. No.: 14/705,307

(22) Filed: May 6, 2015

(65) Prior Publication Data

US 2016/0090673 A1 Mar. 31, 2016

(30) Foreign Application Priority Data

Sep. 26, 2014 (TW) ..... 103133594 A

(51) Int. Cl.

| | |
|---|---|
| ***D05C 5/02*** | (2006.01) |
| ***D05B 3/02*** | (2006.01) |
| ***D05B 19/08*** | (2006.01) |
| ***D05B 47/04*** | (2006.01) |

(52) U.S. Cl.

CPC ..... *D05B 3/02* (2013.01); *D05B 19/08* (2013.01); *D05B 47/04* (2013.01)

(58) Field of Classification Search

CPC ..... D05B 19/08; D05B 61/00; D05B 47/00; D05B 73/12

USPC ..... 112/475.19, 475, 17, 254, 157, 102.5, 112/453

See application file for complete search history.

(56) References Cited

U.S. PATENT DOCUMENTS

| | | | | |
|---|---|---|---|---|
| 6,098,559 A * | 8/2000 | Hirose | D05B 19/12 | 112/102.5 |
| 6,532,883 B2 * | 3/2003 | Omiya | D05B 19/12 | 112/454 |
| 8,875,642 B2 * | 11/2014 | Kawai | D05B 3/00 | 112/254 |
| 2014/0324210 A1 * | 10/2014 | Mizuno | D05B 19/12 | 700/138 |

* cited by examiner

*Primary Examiner* — Tejash Patel
(74) *Attorney, Agent, or Firm* — Trop Pruner & Hu, P.C.

(57) ABSTRACT

In a method for controlling sewing operation of a sewing machine, a stitch needle completes an in-and-out movement on a fabric with a first tension applied to an upper thread when the stitch needle, with respect to a fabric-feeding mechanism, is at a first relative position corresponding to a first pattern part of a predetermined stitch pattern. Afterward, the stitch needle is moved, with respect to the fabric-feeding mechanism, to a second relative position corresponding to a second pattern part of the predetermined stitch pattern, and completes an in-and-out movement on the fabric at the second relative position with a second tension, which is greater than the first tension, applied to the upper thread.

8 Claims, 5 Drawing Sheets

METHOD FOR CONTROLLING SEWING OPERATING OF A SEWING MACHINE

CROSS-REFERENCE TO RELATED APPLICATION

This application claims priority of Taiwanese Application No. 103133594, filed on Sep. 26, 2014.

FIELD

The disclosure relates to a method for controlling sewing operation of a sewing machine.

BACKGROUND

Operation of a conventional sewing machine may be described as follows. Referring to FIG. 1, when it is intended to sew a stitch on a fabric 9, a sewing needle (not depicted in the drawings) that carries an upper thread 91 is driven to move downwardly through the fabric 9. Correspondingly, a shuttle (not depicted in the drawings) that carries an under thread 92 is driven to allow the under thread 92 to be connected to the upper thread 91. Afterward, the sewing needle is pulled upward, tightening the under thread 92 and thereby completing a stitch.

The sewing needle is then driven to move horizontally to another position. Cooperating with the movement of a fabric-feeding mechanism, the sewing needle is moved with respect to the fabric 9 in order to sew another stitch at a different location on the fabric 9.

It is noted that however, in sewing some particular patterns, horizontal displacements of the sewing needle between stitches may vary. Consequently, applying an identical tension onto the upper thread 91 in each of the stitches may result in differences in the length of the upper thread 91 supplied between the stitches. For example, when sewing a zigzag pattern as illustrated in FIG. 1, during movement of the sewing needle away from a first stitch (i.e., to a left side), an insufficient tension may lead to supply of a longer length of the upper thread 91, and consequently, excessive amount of the upper thread 91 will be left on a back side the fabric 9.

SUMMARY

Therefore, an object of the disclosure is to provide a method that can alleviate at least one of the drawbacks of the prior arts.

According to the disclosure, a method is for controlling sewing operation of a sewing machine. The sewing machine includes a stitching unit, a control unit and a thread tension controller. The stitching unit includes a stitch needle that carries an upper thread, and a fabric-feeding mechanism that is configured to feed a fabric in a general feeding direction.

The sewing machine is configured to sew a predetermined stitch pattern on the fabric. The predetermined stitch pattern has a first pattern part and a second pattern part which are opposite to each other in a direction transverse to the general feeding direction. The method includes the following steps in the given order:

a) driving, by the control unit, the stitch needle to complete an in-and-out movement on the fabric with a first tension applied by the thread tension controller to the upper thread when the stitch needle is with respect to the fabric-feeding mechanism at a first relative position corresponding to the first pattern part of the predetermined stitch pattern;

b) driving, by the control unit, the stitching unit to change relative position of the stitch needle with respect to the fabric-feeding mechanism from the first relative position to a second relative position corresponding to the second pattern part of the predetermined stitch patter, and adjusting, by the thread tension controller, tension force applied to the upper thread to a second tension that is greater than the first tension; and c) driving, by the control unit, the stitch needle to complete an in-and-out movement on the fabric at the second relative position.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
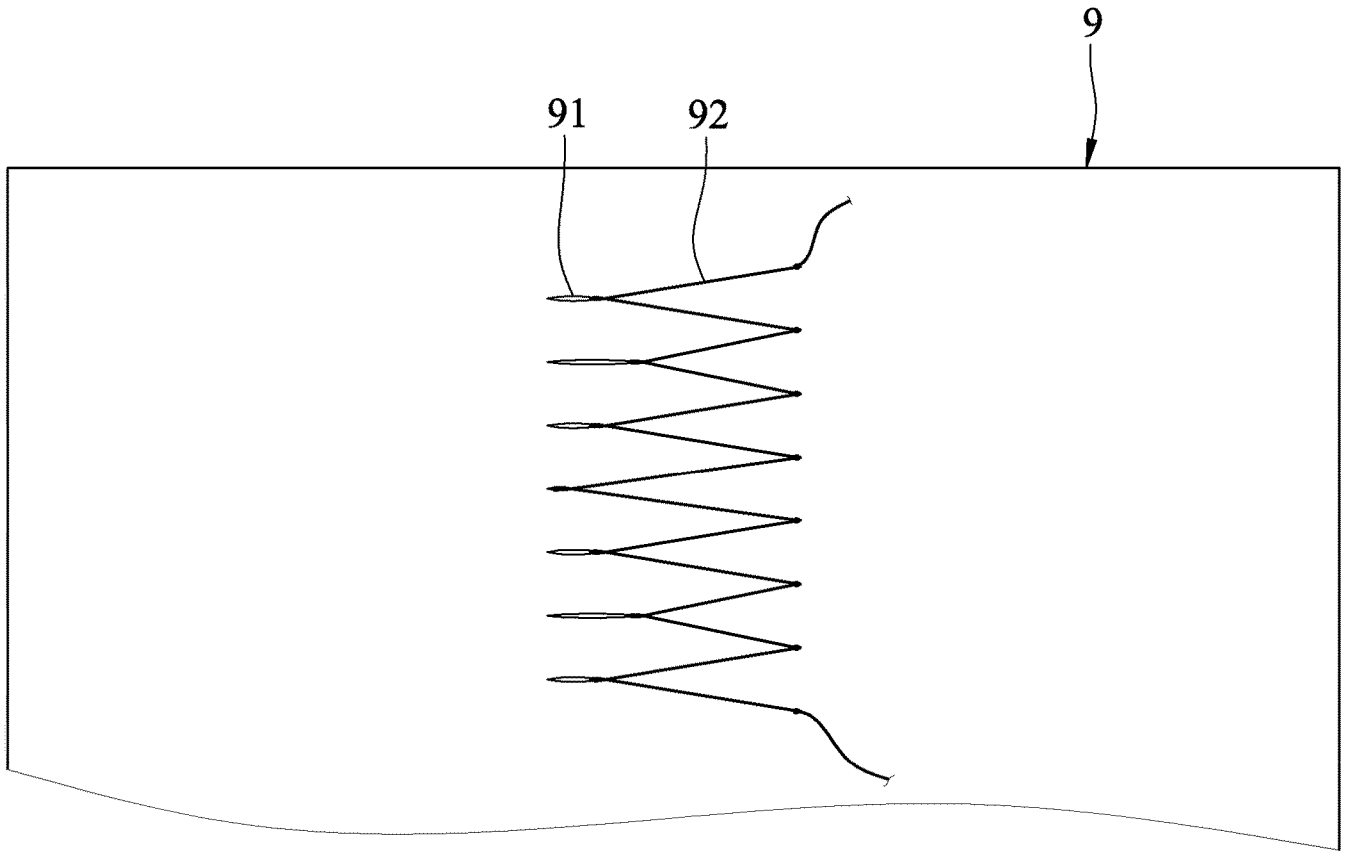
FIG. 1 illustrates operation of a conventional sewing machine.
Figure 2:
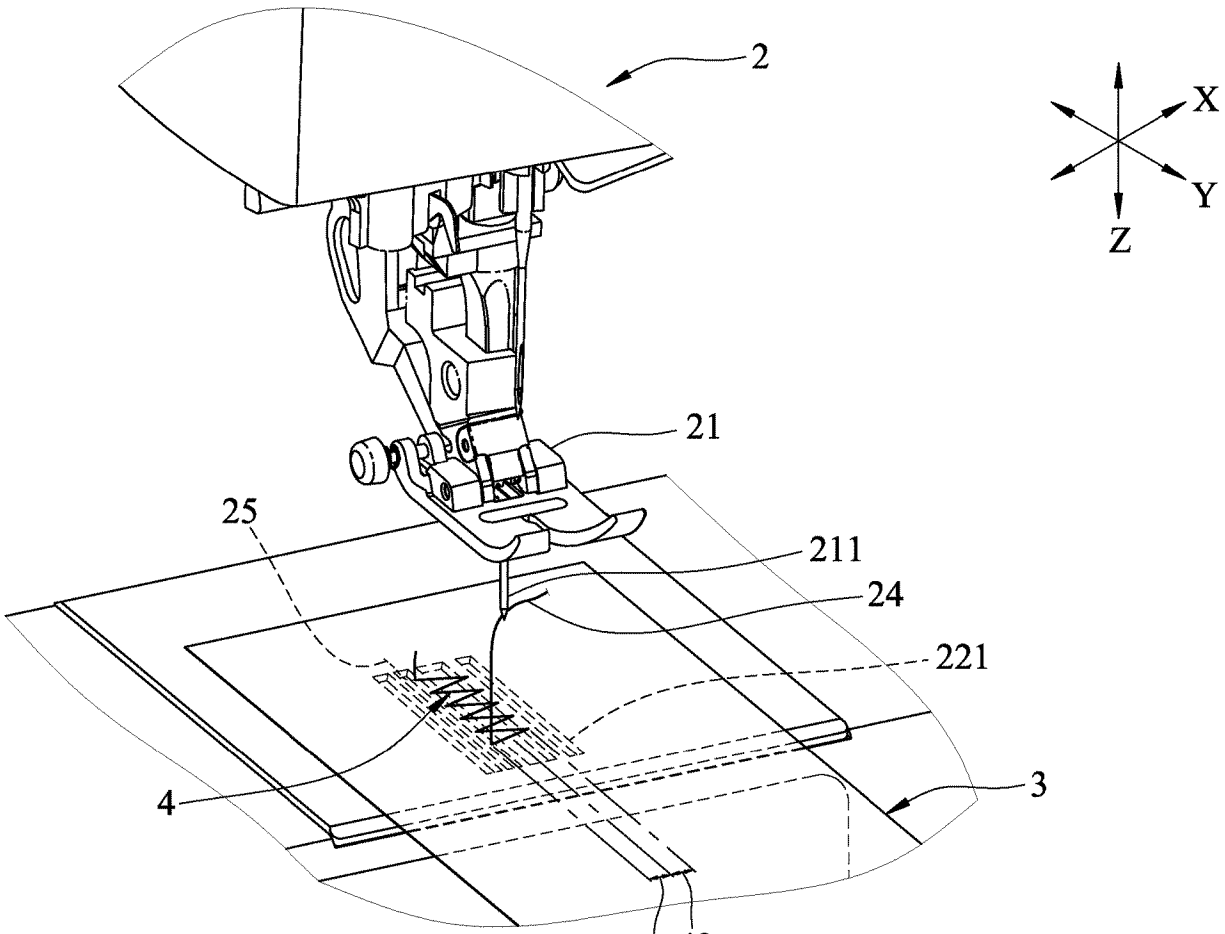
FIG. 2 illustrates a sewing machine according to an embodiment of the disclosure.
Figure 3:
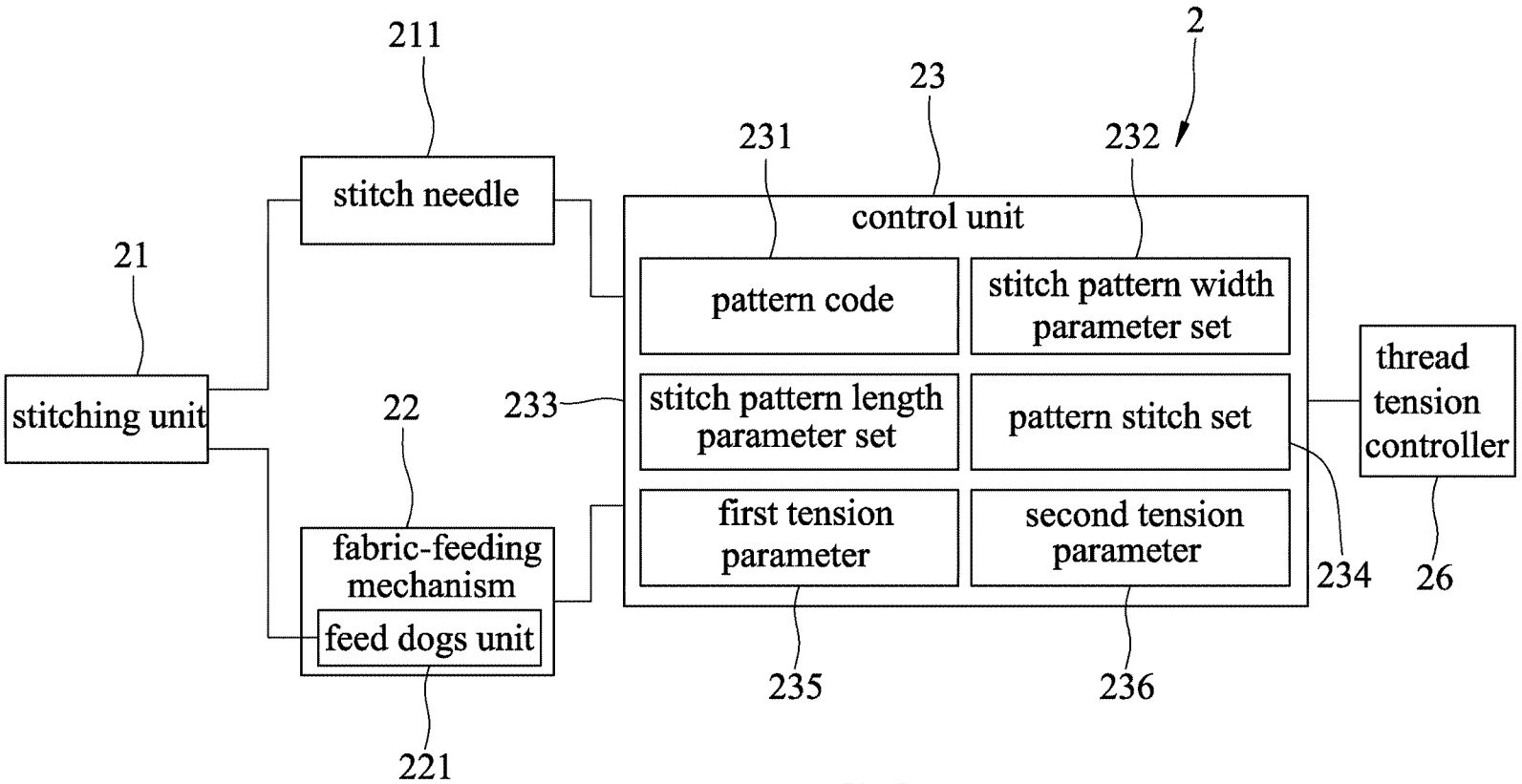
FIG. 3 is a block diagram illustrating components of the sewing machine.

FIGS. 2 and 3 illustrate a sewing machine 2 according to an embodiment of the disclosure. The sewing machine 2 includes a stitching unit 21, a control unit 23 that is coupled to the stitching unit 21, an upper thread source (not depicted in the drawings) that supplies an upper thread 24, a shuttle (not depicted in the drawings) that is placed below a fabric 3 and that carries an under thread 25, and a thread tension controller 26.

The stitching unit 21 includes a fabric-feeding mechanism 22 and a stitch needle 211. The fabric-feeding mechanism 22 is for feeding the fabric 3 in a general feeding direction. The stitch needle 211 carries the upper thread 24 and is driven by the control unit 23 to move. In this embodiment, the control unit 23 is configured to control the stitch needle 211 to move in an up-down direction (Z) and a left-right direction (X).

The fabric-feeding mechanism 22 includes a feed dogs unit 221 that is driven by the control unit 23 to move. In this embodiment, the control unit 23 is configured to control the feed dogs unit 221 to move the fabric 3 in a front-rear direction (Y), i.e., the general feeding direction.

The thread tension controller 26 may be embodied using a step motor, and is configured to pull the upper thread 24 with various tension forces.

When it is intended to perform sewing of a stitch on the fabric 3, the sewing needle 211 that carries the upper thread 24 is driven by the control unit 23 to move downwardly in the up-down direction (Z). Correspondingly, the shuttle that carries the under thread 25 is driven to move in the front-rear direction (Y) so as to allow the under thread 25 to be connected to the upper thread 24.

Afterward, the sewing needle 221 is driven upwardly in the up-down direction (Z) with a tension force applied by the thread tension controller 26 on the upper thread 24 so as to complete the sewing of a stitch. The sewing needle 211 is then driven to move horizontally in the left-right direction (X). Cooperating with the movement of the fabric-feeding mechanism 22 in the front-rear direction (Y), the sewing needle 211 is moved with respect to the fabric 3 to another location in order to sew another stitch.

In embodiments of the disclosure, the term "stitching" refers to the stitch needle 211 completing an in-and-out movement on the fabric 3.

Figure 5:
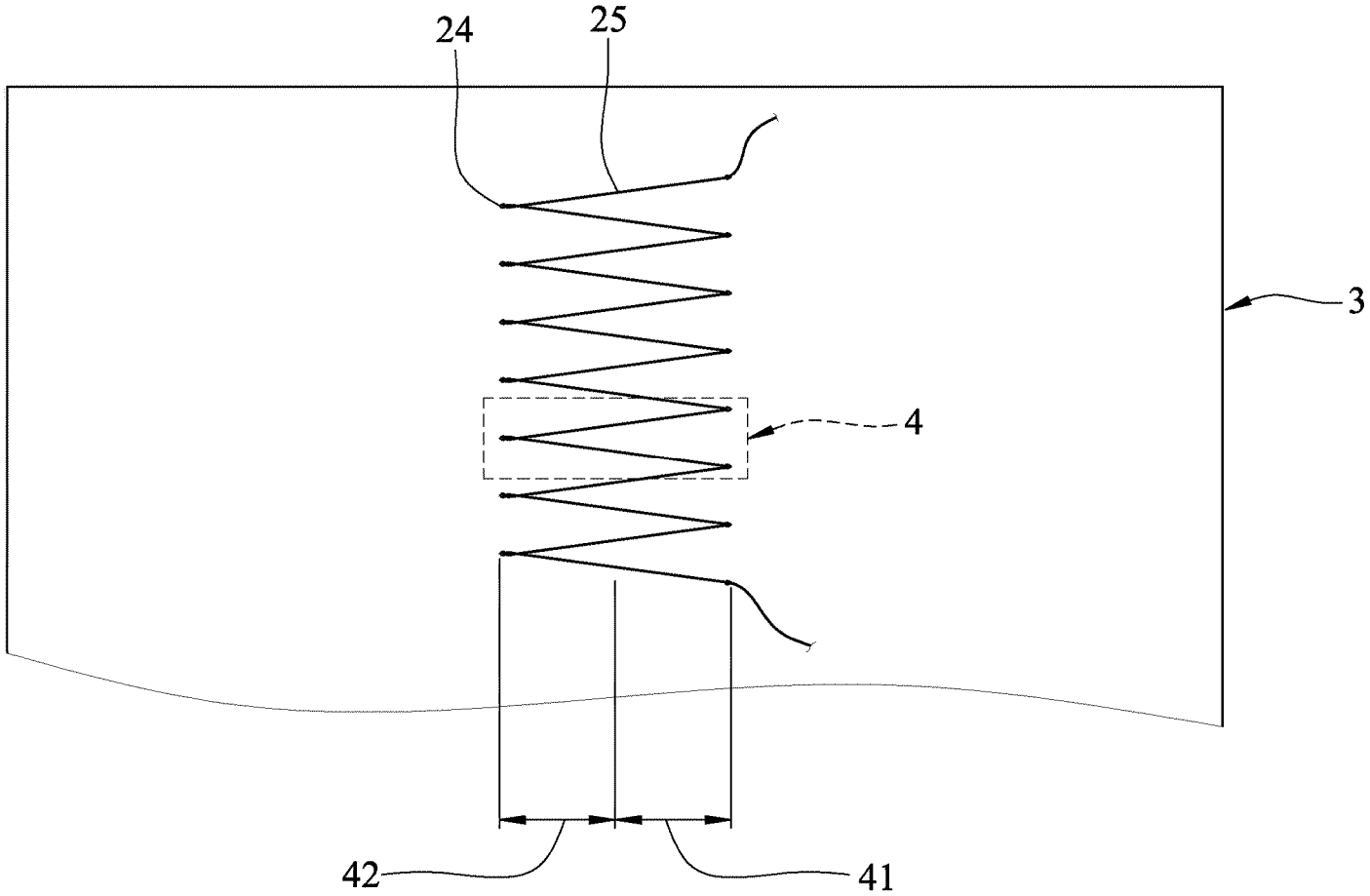
FIG. 5 illustrates operation of the sewing machine controlled by the method of FIG. 4.

In this embodiment, the control unit 23 stores a pattern code 231 associated with a predetermined stitch pattern 4, a stitch pattern width parameter set 232 associated with a width of the predetermined stitch pattern 4 (or widths of various segments of the predetermined stitch pattern 4), a stitch pattern length parameter set 233 associated with a length of the predetermined stitch pattern 4 (or lengths of various segments of the predetermined stitch pattern 4), and a pattern stitch set 234 indicating a plurality of relative positions of the stitch needle 211 with respect to the fabric-feeding mechanism 22 for making the predetermined stitch pattern 4. For example, the predetermined stitch pattern 4 as shown in FIG. 5 is a V-shaped pattern, and a plurality of the V-shaped predetermined stitch patterns 4 are arranged together in the front-rear direction (Y) to forma zigzag pattern. In practice, the control unit 23 may store a plurality of pattern codes associated respectively with a plurality of predetermined stitch patterns, and a user can select a desired one of the predetermined stitch patterns to be sewed.

In one example, the stitch pattern width parameter set 232 directly specifies a value of the width of the predetermined stitch pattern 4, and the stitch pattern length parameter set 233 directly specifies a value of the length of the predetermined stitch pattern 4. In another example, the stitch pattern width parameter set 232 and the stitch pattern length parameter set 233 may be calculated respectively by multiplying a predetermined weight to the values of length and the width of the predetermined stitch pattern 4 (or lengths and widths of various segments of the predetermined stitch pattern 4).

The control unit 23 further stores a first tension parameter 235 and a second tension parameter 236 that are associated with the predetermined stitch pattern 4. In this embodiment, the first tension parameter 235 is a pre-stored constant, and the second tension parameter 236 is a value that is calculated based on the stitch pattern width parameter set 232, the stitch pattern length parameter set 233 and the first tension parameter 235.

In one alternative embodiment, both the first tension parameter 235 and the second tension parameter 236 are pre-stored constants. In another alternative embodiment, the first tension parameter 235 may be a variable parameter derived using other calculations.

In this embodiment, the predetermined stitch pattern 4 has a first pattern part 41 and a second pattern part 42. The first pattern part 41 and the second pattern part 42 are opposite to each other in position, and are opposite to each other in the left-right direction (X), which is transverse to the general feeding direction (Y). A width of the first pattern part 41 is equal to a width of the second pattern part 42, and a summation of the widths of the first and second pattern parts 41 and 42 is equal to the width of the predetermined stitch pattern 4 in the left-right direction (X).

Figure 4:
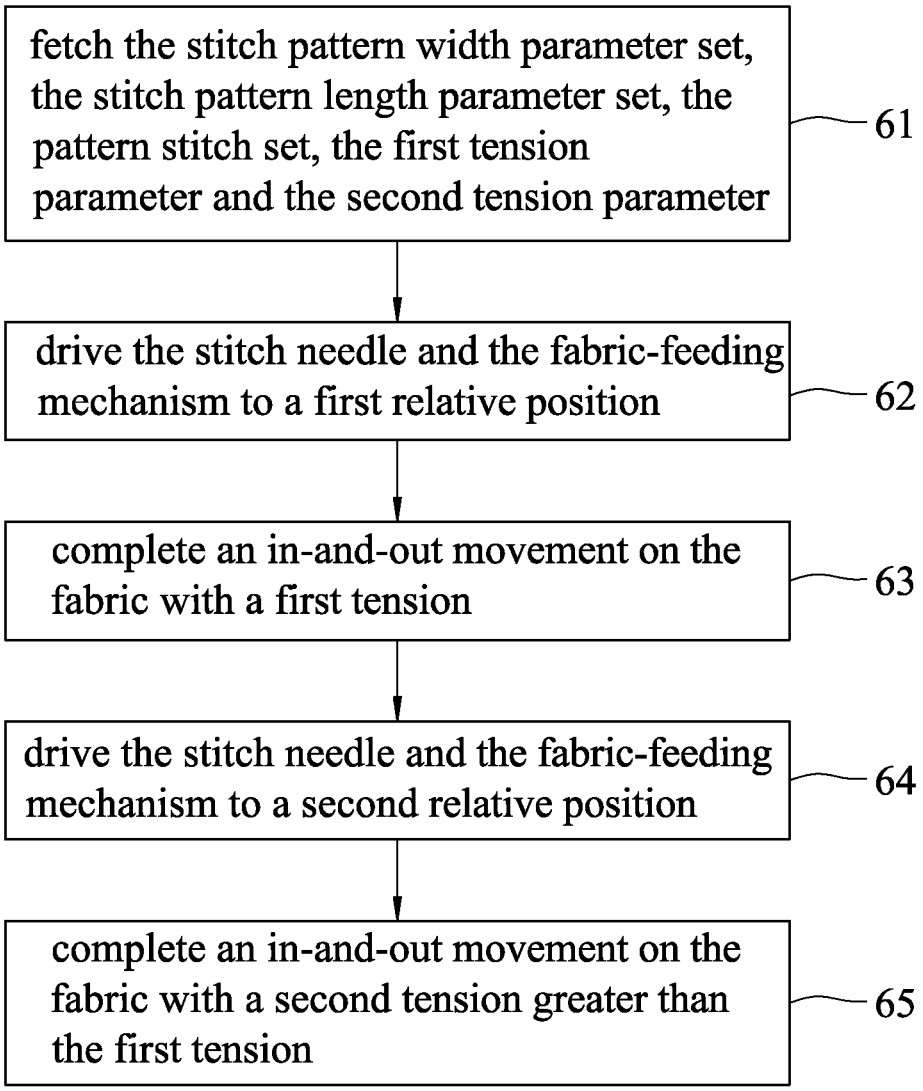
FIG. 4 is a flow chart illustrating steps of a method for controlling operation of the sewing machine according to an embodiment of the disclosure.

FIG. 4 illustrates a method for controlling sewing operation of the sewing machine 2 according to the disclosure.

In step 61, the control unit 23 fetches the stitch pattern width parameter set 232, the stitch pattern length parameter set 233, the pattern stitch set 234, the first tension parameter 235 and the second tension parameter 236 according to the pattern code 231 that is associated with the selected predetermined stitch pattern 4 to be sewed onto the fabric 3.

In step 62, the control unit 23 drives movements of the stitch needle 211 and the fabric-feeding mechanism 22, in order to initiate stitching of the predetermined stitch pattern 4 on the fabric 3.

In particular, for the very first stitching action, the stitch needle 211, with respect to the fabric-feeding mechanism 22, is positioned at a first relative position corresponding to the first pattern part 41 of the predetermined stitch pattern 4. In this embodiment, the control unit 23 is configured to move the stitch needle 211 while the fabric-feeding mechanism 22 is unknot moved. In other embodiments, the control unit 23 may be configured to move the fabric-feeding mechanism 22 instead of the stitch needle 211.

Then, in step 63, the control unit 23 drives the stitch needle 211 in the up-down direction (Z) so as to complete an in-and-out movement on the fabric 3 (i.e., to make a "stitch") at the first relative position with a first tension applied by the thread tension controller 26 to the upper thread 24. In other words, the thread tension controller 26 is controlled by the control unit 23 to adjust the tension force applied to the upper thread 24 to the first tension according to the first tension parameter 235 that is pre-stored in the control unit 23.

In step 64, the control unit 23 changes the relative position between the stitch needle 211 and the fabric-feeding mechanism 22, such that the stitch needle 211, with respect to the fabric-feeding mechanism 22, is positioned at a second relative position corresponding to the second pattern part 42 of the predetermined stitch pattern 4.

Particularly, the control unit 23 changes the relative position of the stitch needle 211 with respect to the fabric-feeding mechanism 22 between the first and second relative positions according to the pattern stitch set 234. The pattern stitch set 234 is pre-stored in the control unit 23 and indicates the plurality of relative positions of the stitch needle 211 with respect to the fabric-feeding mechanism 22, where the stitch needle 211 completes respective in-and-out movements for forming the predetermined stitch pattern 4.

In step 65, the control unit 23 drives the stitch needle 211 in the up-down direction (Z) so as to complete another in-and-out movement on the fabric 3 at the second relative position. In particular, for this in-and-out movement in step 65, the thread tension controller 26 adjusts the tension force applied to the upper thread 24 to a second tension, which is greater than the first tension.

In one example, the first tension parameter 235 and the second tension parameter 236 directly specify values of the first tension and the second tension, respectively.

Afterward, the above sequential steps 61 to 65 may be repeated in order to complete the sewing operation for composing the zigzag pattern as shown in FIG. 5. In operation, the in-and-out movements made by the stitch needle 211 alternatively land on the fabric 3 at the first and second pattern parts 41 and 42.

Accordingly, when a current in-and-out movement is to be made at the second relative position and immediately after a prior in-and-out movement made at the first relative position, the thread tension controller 26 increases the tension force applied to the upper thread 24 for making the current in-and-out movement. Alternatively, when a current in-and-out movement requires the relative position to be changed to the first relative position from the second relative position, the thread tension controller 26 decreases the tension force applied to the upper thread 24 (e.g., to the first tension). In this manner, the length of the upper thread 24 left on a back side of the fabric 3 can be kept constant.

It is noted that, in a case where two in-and-out movements are to made in succession at a same relative position (i.e., the stitch needle 211 is not moved in the left-right direction (X)), the thread tension controller 26 is not configured to adjust the tension force for the latter in-and-out movements. That is to say, the thread tension controller 26 only adjusts the tension force when a relative position of the stitch needle 211 with respect to the fabric-feeding mechanism 22 is changed in the left-right direction (X).

To sum up, the method of the disclosure is capable of automatically adjusting the tension force applied to the upper thread 24 for different stitches, and is therefore able to address the drawbacks of the prior art.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A method for controlling sewing operation of a sewing machine, the sewing machine including a stitching unit, a control unit and a thread tension controller, the stitching unit including a stitch needle that carries an upper thread and a fabric-feeding mechanism that is configured to feed a fabric in a general feeding direction, the sewing machine being configured to sew a predetermined stitch pattern on the fabric, the predetermined stitch pattern having a first pattern part and a second pattern part which are opposite to each other in a direction transverse to the general feeding direction, the method comprising the following steps in the given order:

a) driving, by the control unit, the stitch needle to complete an in-and-out movement on the fabric with a first tension applied by the thread tension controller to the upper thread when the stitch needle is with respect to the fabric-feeding mechanism at a first relative position corresponding to the first pattern part of the predetermined stitch pattern;

b) after the in-and-out movement, driving, by the control unit, the stitching unit to change relative position of the stitch needle with respect to the fabric-feeding mechanism from the first relative position to a second relative position corresponding to the second pattern part of the predetermined stitch pattern, and adjusting, by the thread tension controller, tension force applied to the upper thread to a second tension that is greater than the first tension; and c) driving, by the control unit, the stitch needle to complete an in-and-out movement on the fabric at the second relative position with the second tension.

2. The method of claim 1, further comprising the step of repeating steps a) to c).

3. The method of claim 1, wherein the control unit is configured to control the stitch needle to complete the in-and-out movement in an up-down direction, and to change the relative position of the stitch needle with respect to the fabric-feeding mechanism between the first and second relative positions in a left-right direction, wherein the general feeding direction in which the fabric-feeding mechanism feeds the fabric is a front-rear direction, and the up-down direction, the left-right direction and the front-rear direction are perpendicular to one another, wherein the first pattern part and the second pattern part are opposite to each other in the left-right direction.

4. The method of claim 3, wherein a width of the first pattern part is equal to a width of the second pattern part, and a summation of the widths of the first and second pattern parts is equal to a width of the predetermined stitch pattern in the left-right direction.

5. The method of claim 1, wherein, in step a), the control unit is configured to control the thread tension controller to adjust the tension force applied to the upper thread to be the first tension according to a first tension parameter that is pre-stored in the control unit.

6. The method of claim 5, wherein, in step b), the control unit is configured to control the thread tension controller to adjust the tension force applied to the upper thread to be the second tension according to a second tension parameter that is stored in the control unit and that is calculated based on a stitch pattern width and a stitch pattern length of the predetermined stitch pattern and the first tension parameter.

7. The method of claim 1, wherein the control unit is configured to change the relative position of the stitch needle with respect to the fabric-feeding mechanism between the first and second relative positions according to a pattern stitch set that is pre-stored in the control unit and that indicates a plurality of relative positions of the stitch needle with respect to the fabric-feeding mechanism where the stitch needle completes respective in-and-out movements for forming the predetermined stitch pattern.

8. The method of claim 1, wherein, the predetermined stitch pattern is a V-shaped pattern.

* * * * *